US007555857B2

(12) United States Patent
McCabe

(10) Patent No.: US 7,555,857 B2
(45) Date of Patent: Jul. 7, 2009

(54) ARTICLE OF LAUNDRY SPREADER AND STACKER

(76) Inventor: Stanley G. McCabe, 9603 York Ave., Lubbock, TX (US) 79424

( * ) Notice: Subject to any disclaimer, the term of this patent is extended or adjusted under 35 U.S.C. 154(b) by 227 days.

(21) Appl. No.: 11/521,255

(22) Filed: Sep. 13, 2006

(65) Prior Publication Data

US 2008/0092415 A1 Apr. 24, 2008

(51) Int. Cl.
*D06F 67/04* (2006.01)
*D06F 71/38* (2006.01)

(52) U.S. Cl. ..... 38/143

(58) Field of Classification Search ..... 38/143, 38/2, 8; 198/803.3, 836.1, 364, 890.1, 448; 271/9.04; 414/13
See application file for complete search history.

(56) References Cited

U.S. PATENT DOCUMENTS

| | | | | |
|---|---|---|---|---|
| 1,912,724 | A | 6/1933 | Remington | |
| 1,997,267 | A * | 4/1935 | Remington | 38/2 |
| 3,092,263 | A | 6/1963 | Beaudry et al. | |
| 3,092,271 | A | 6/1963 | Beaudry et al. | |
| 3,168,307 | A | 2/1965 | Walton et al. | |
| 3,421,756 | A | 1/1969 | Weir | |
| 3,429,063 | A | 2/1969 | Myers | |
| 3,553,863 | A | 1/1971 | Sjostrom | |
| 3,664,046 | A * | 5/1972 | Thompson | 38/143 |
| 3,696,942 | A | 10/1972 | Kitchener et al. | |
| 3,791,057 | A * | 2/1974 | Hall | 38/143 |
| 3,874,043 | A | 4/1975 | Holm | |
| 3,911,604 | A | 10/1975 | Sjostrom | |
| 4,053,967 | A | 10/1977 | Mair | |
| 4,106,227 | A | 8/1978 | Allen et al. | |
| 4,299,521 | A | 11/1981 | Jensen | |
| 4,327,510 | A * | 5/1982 | Grantham | 38/8 |
| RE31,453 | E | 12/1983 | Olsen et al. | |
| 4,447,972 | A | 5/1984 | McCabe | |
| 4,774,505 | A | 9/1988 | Ueda et al. | |
| 4,943,198 | A | 7/1990 | McCabe | |
| 4,979,868 | A | 12/1990 | Ueda et al. | |
| 5,046,272 | A | 9/1991 | Vogt et al. | |
| 5,168,645 | A | 12/1992 | Robin et al. | |
| 5,169,282 | A | 12/1992 | Ueda et al. | |
| 5,172,502 | A | 12/1992 | Kober | |
| 5,179,795 | A | 1/1993 | Nakamura et al. | |
| 5,300,007 | A | 4/1994 | Kober | |

(Continued)

FOREIGN PATENT DOCUMENTS

| | | |
|---|---|---|
| GB | 2219313 | 12/1989 |

*Primary Examiner*—Ismael Izaguirre
(74) *Attorney, Agent, or Firm*—Brinks, Hofer, Gilson & Lione

(57) ABSTRACT

Two paths parallel paths feed a common path. A clamp removes separate articles in each parallel path. Each path positions articles on opposite sides of a surface, such as a conveyor. In a back and forth motion, another clamp sequentially clamps the articles of laundry from the opposite sides and places each article on the surface. Another clamp extends through the surface to sequentially clamp the articles on a trailing edge. The clamp moves the articles linearly off the surface and rotates the articles onto another surface, such as a lower surface. On the other surface, the article is conveyed to a pick-up position. A pair of clamps drag the article by an edge onto a stacked position. The stack is adjusted in height to position the stack for receiving the next article.

32 Claims, 3 Drawing Sheets

U.S. PATENT DOCUMENTS

| | | | | |
|---|---|---|---|---|
| 5,333,402 | A | 8/1994 | Weir | |
| 5,416,992 | A | 5/1995 | Ueda et al. | |
| 5,440,810 | A | 8/1995 | Borucki et al. | |
| 5,515,627 | A | 5/1996 | McCabe | |
| 5,546,684 | A | 8/1996 | Jensen | |
| 5,595,467 | A | 1/1997 | Jensen | |
| 5,611,159 | A | 3/1997 | Jensen | |
| 6,141,893 | A | 11/2000 | McCabe | |
| 6,477,797 | B1 | 11/2002 | Takahashi et al. | |
| 6,533,267 | B1 | 3/2003 | Muessig et al. | |
| 6,584,711 | B1 | 7/2003 | Nakamura | |
| 6,826,856 | B1 | 12/2004 | McCabe | |
| 6,883,258 | B2 | 4/2005 | McCabe | |
| 7,127,840 | B2 * | 10/2006 | McCabe | 38/143 |
| 2005/0028410 | A1 | 2/2005 | McCabe | |

* cited by examiner

ARTICLE OF LAUNDRY SPREADER AND STACKER

BACKGROUND

The present invention relates to automated laundry spreaders and/or stackers. In particular, a spreader for laying out articles of laundry and a stacker for stacking spread towels are provided.

Many processes in laundries are automated. For example, machines in hotels spread out, iron, and fold sheets without operator intervention. To begin the automated process, the operator identifies either corners or an edge of the sheet and places the corners or edge into the first machine. Since sheets have large dimensions with thin fabric, the sheets are often tangled together, necessitating either an automated separator machine or an operator for locating the edges or corners.

Since towels are smaller and thicker, towels may be less likely tangled after removal from a washing or drying machine. However, in typical towel processing, an operator still grabs individual towels and places them on folding machines. Where possible, automated processes may save money over time.

Machines for automatically grabbing towels from a load of towels and spreading the towels have been attempted, but find little commercial success. Typically, these machines attempt to isolate diagonal corners and then opposite corners. Such isolation can be difficult and inconsistent when implemented with a machine.

BRIEF SUMMARY

By way of introduction, the preferred embodiments described below include apparatuses and methods for spreading and/or stacking articles of laundry from a load of articles of laundry. Two paths, such as two similar, identical, and/or parallel paths, remove articles from the load. A clamp removes separate articles in each path. The clamp drops the articles onto a plate. Another clamp moves horizontally to remove the article from the plate and position a trailing corner in a clutch roll. Each path positions articles on opposite sides of a surface, such as a conveyor. In a back and forth motion, another clamp sequentially clamps the articles of laundry from the opposite sides and places each article on the surface. The back and forth motion allows clamping and depositing from one side while positioning the clamp adjacent the other side. Another clamp extends through the surface to sequentially clamp the articles on a trailing edge. The clamp moves the articles linearly off the surface and rotates the articles onto another surface, such as a lower surface. On the other surface, the article is conveyed to a pick-up position. If properly positioned, a pair of clamps drags the article by an edge onto a stacker position. The stack is adjusted in height to position the stack for receiving the next article. Once the stack is sufficiently high, the stack is conveyed away. Alternatively, the articles proceed to a folding machine without prior stacking.

Each of the individual stages described above may be used in different apparatuses. Each individual stage is used with or without other stages described above. Any of the overall structure, individual stages, combinations of individual stages, and associated methods of the embodiments discussed below may be claimed independently herein.

In a first aspect, an apparatus is provided for spreading laundry from a load of articles of laundry. A clamp is operable to clamp a first article of laundry at a first side of a position for depositing articles. The clamp is operable to release the first article of laundry at the position and operable to clamp a second article of laundry at a second side of the position, the second side different than the first side. The clamp is operable to release the second article of laundry at the position.

In a second aspect, a method is provided for spreading laundry from a load of articles of laundry. Articles of laundry are moved in two separate paths away from the load. The articles of laundry from spaced apart locations corresponding to the two separate paths are placed onto a common path downstream of the two separate paths. The articles of laundry from the two separate paths are moved along the common path.

In a third aspect, an apparatus is provided for spreading laundry from a load of articles of laundry. A surface has at least one groove. A clamp is operable to clamp an article of laundry on the surface. The clamp is at least in part in the at least one groove. A drive is operable to move the clamp and/or the article away from the surface.

In a fourth aspect, a method is provided for spreading laundry from a load of articles of laundry. An article of laundry is positioned on a first surface. A clamp extends through a slot in the first surface. The article of laundry is clamped with the clamp and moved off the first surface with the clamp.

In a fifth aspect, an apparatus is provided for stacking spread laundry from a load of articles of laundry. A surface is operable to support a stack of laundry. A clamp is operable to clamp an edge of an article of laundry at a position spaced from the surface and position the article of laundry on the stack.

In a sixth aspect, a method is provided for stacking spread laundry from a load of articles of laundry. An edge of an article of laundry is grabbed. The article of laundry is dragged by the edge onto a stack of laundry.

In a seventh aspect, a method is provided for spreading laundry from a load of articles of laundry. A first article of laundry is selected for a first path. A second article of laundry is selected for a second path separate from the first path. The first and second articles of laundry are disposed on first and second opposite sides, respectively, of a first surface. The first and second articles of laundry are sequentially clamped with a same first clamp in a back and forth operation of the clamp between the first and second opposite sides. The clamp positions the first and second articles of laundry on the first surface during the back and forth operation. The first and second articles of laundry are clamped sequentially with a second clamp extending through a slot in the first surface. The first and second articles of laundry are moved with the second clamp off the first surface and onto a second surface. The second surface is spaced from the first surface.

In an eighth aspect, an apparatus is provided for spreading laundry from a load of articles of laundry. A first clamp is operable to clamp a first article of laundry. A second clamp is operable to clamp a second article of laundry. A first drive is operable to drive the first clamp to adjacent a first side of a first surface. A second drive is operable to drive the second clamp to adjacent a second side, opposite the first side, of the first surface. A third clamp is operable to sequentially clamp the first and second articles of laundry. A third drive is operable to move the third clamp between the first and second sides. The third clamp is operable to deposit the first article of laundry on the first surface during movement from the first side to the second side and operable to deposit the second article of laundry on the first surface during movement from the second side to the first side. A fourth clamp is operable to clamp the first and second articles of laundry sequentially through a slot in the first surface. A fourth drive is operable to move the fourth clamp through the slot and above a second surface. The fourth clamp is operable to deposit the first and second articles of laundry sequentially on the second surface.

The present invention is defined by the following claims, and nothing in this section should be taken as a limitation on those claims. Further aspects and advantages of the invention are discussed below in conjunction with the preferred embodiments.

BRIEF DESCRIPTION OF SEVERAL VIEWS OF THE DRAWINGS

The components of the figures are not necessarily to scale, emphasis instead being placed upon illustrating the principles of the invention. Moreover, in the figures, like reference numerals designate corresponding parts throughout the different views.

DETAILED DESCRIPTION OF THE PREFERRED EMBODIMENTS

FIGS. 1-4 show various aspects of one embodiment. Various stages and aspects of the embodiment may be altered or changed based on now known or later developed devices or methods. The spreader isolates the articles of laundry from a load of articles, spreads the article out flat, and stacks the articles. The stack may be bound, tied or not further processed. In an alternative embodiment, the articles are not stacked, but output for folding. For example, the article is output to an automated towel folder, such as disclosed in U.S. Pat. No. 5,300,007, the disclosure of which is incorporated herein by reference.

The spreader described herein is adapted for isolating and spreading rectangular or square towels. For example, terry cloth hand, wash or beach towels with short sides ranging from 6 to 40 inches and long sides ranging from 18 to 90 inches are processed. As another example, one or more of the stages described herein are used for processing square towels, such as face towels. Larger or smaller articles of laundry may also be processed. Towels of thinner material, such as woven or knit pillow cases, pillow shams, or other laundry articles, may also be processed. Other articles of laundry, such as sheets or blankets, may also be spread or arranged for spreading using one, more or all of the stages described herein.

FIGS. 1-4 show one apparatus positioned within a single frame structure. Different portions of the apparatus are shown in different views to illustrate the components in operation of various stages for spreading a towel. In one embodiment, the stages are built together within the frame work in as small a space as possible while providing sufficient volume for spreading the towel. Various plates for safety and preventing operators from entanglement within the spreader are included, but not shown. Electrical, hydraulic and air pressure cables and hoses interconnect various components for controlling and operating spreading of the towel. These cables and hoses are configured and routed as is known in the art or later developed. One or more controllers also control the actions of various components as is known. Air nozzles may be used to flatten, remove folds, and/or position the article throughout the process.

Sensors for determining proper position, layout, or errors in processing, such as infrared or optical sensors, are used at any position or stage of processing. The sensors provide input for controlling the conveyors, clamps, drives or other components. Any now known or later developed sensors may be used.

Figure 1:
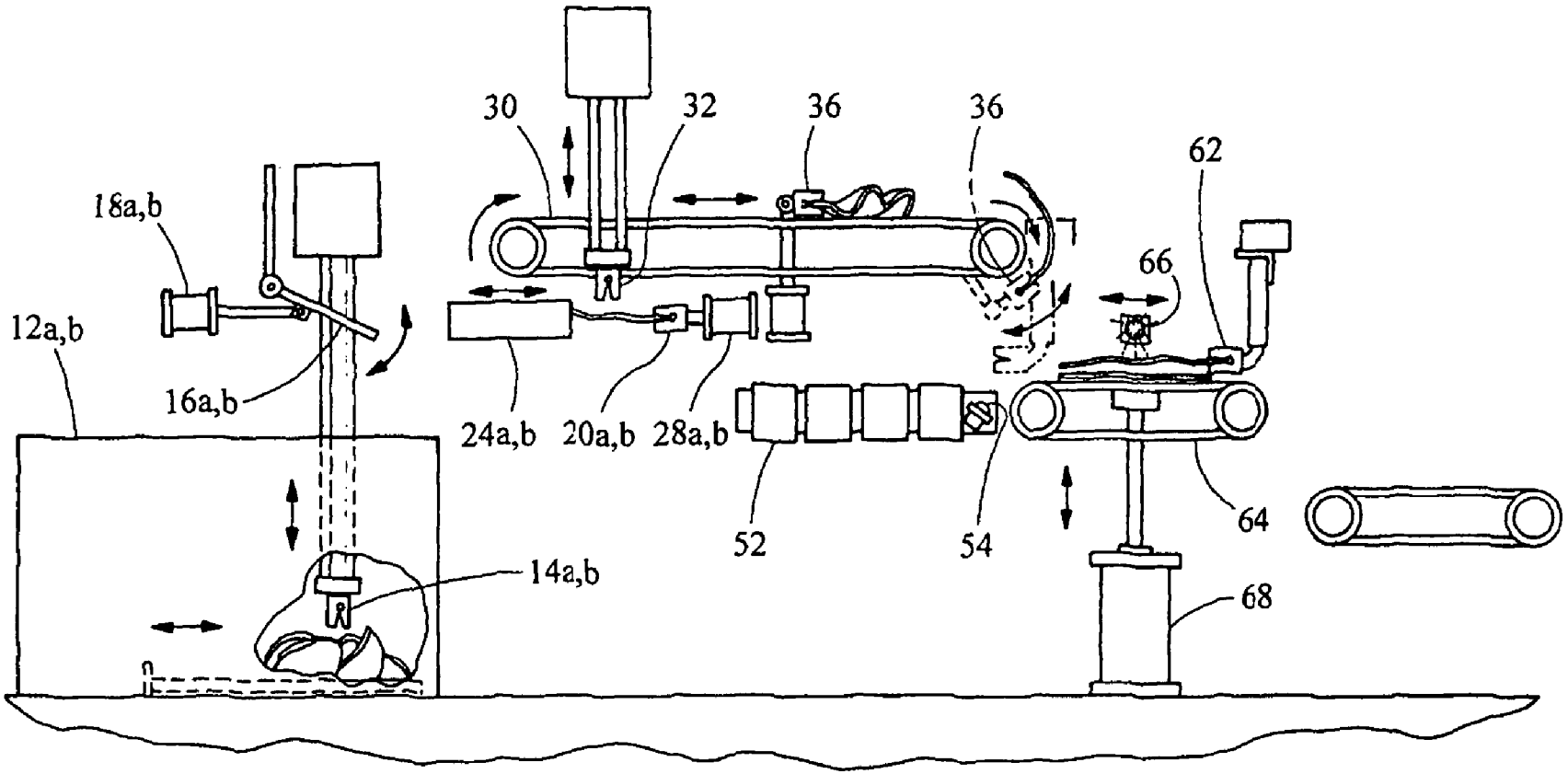
FIG. 1 is a top view of a laundry spreader and stacker according to one embodiment.
Figure 2:
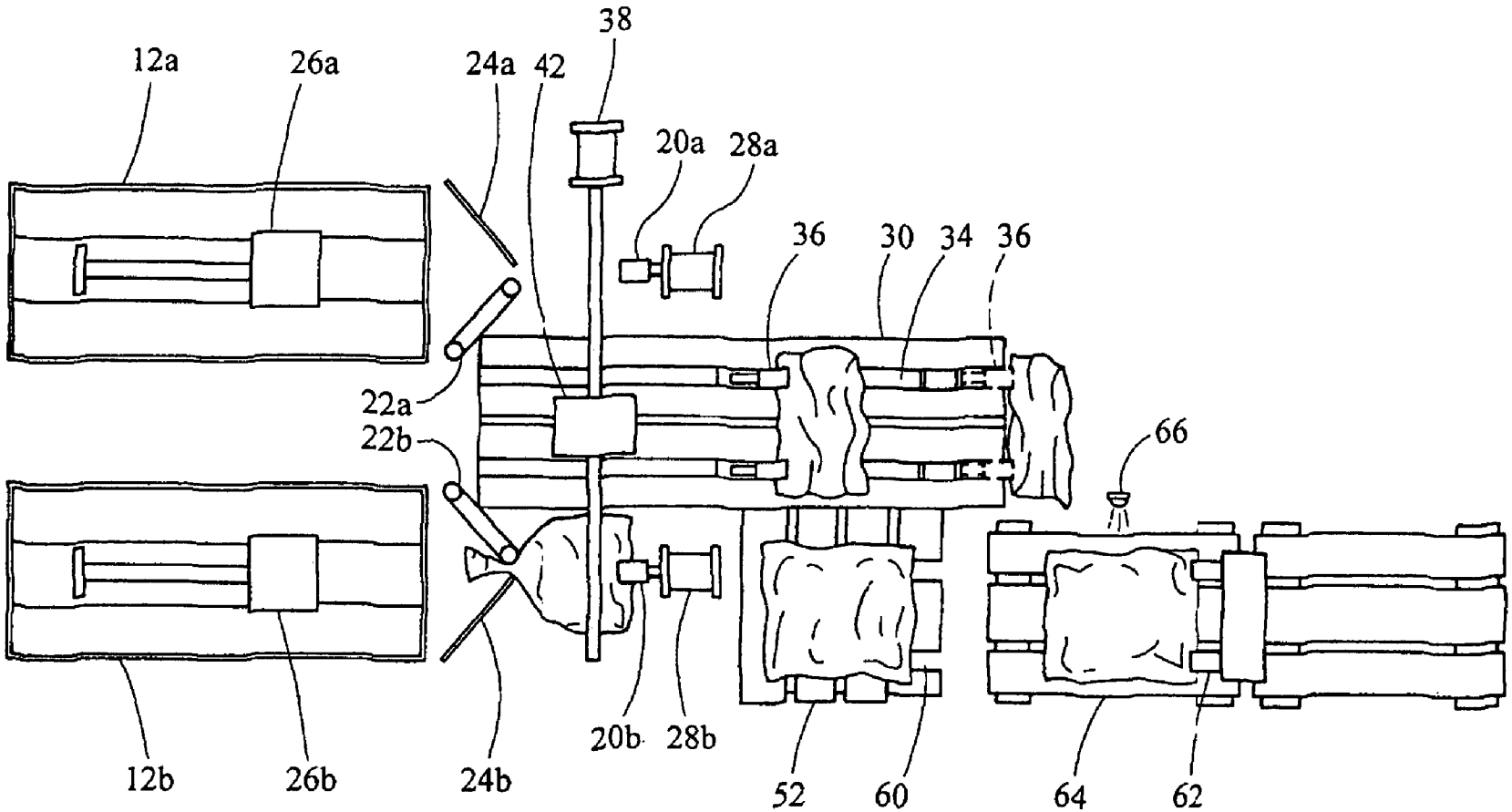
FIG. 2 is a side view of the laundry spreader and stacker of FIG. 1.
Figure 3:
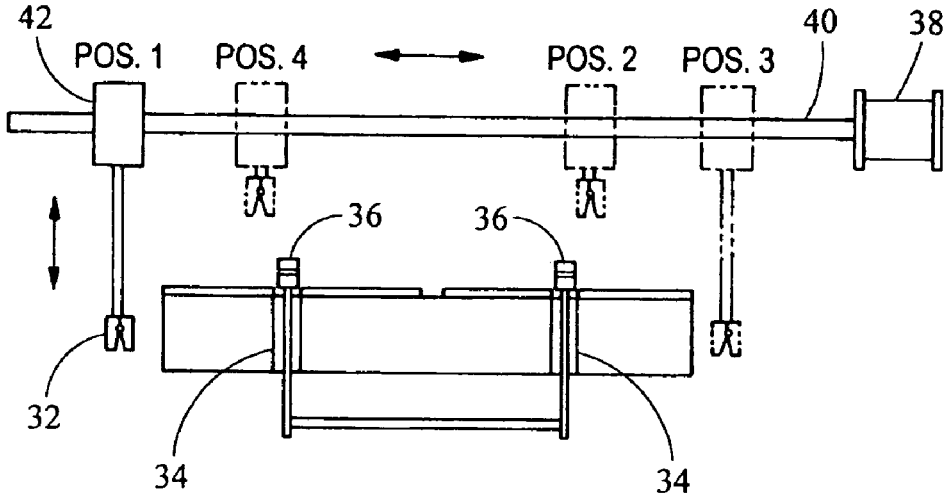
FIG. 3 is a view of some of the components shown in FIGS. 1 and 2.
Figure 4:
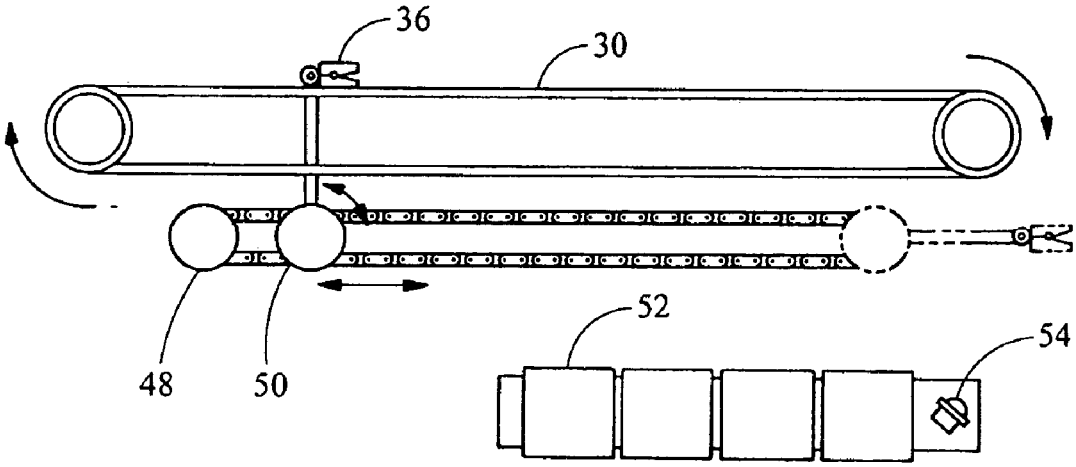
FIG. 4 is a view of other components shown in FIGS. 1 and 2.

FIG. 1 shows a top view of one embodiment. FIG. 2 shows a side view of the embodiment. FIGS. 3 and 4 show some of the clamping and associated components. The embodiment is an apparatus for spreading laundry from a load of articles of laundry. A method for spreading laundry from a load of articles of laundry is described with respect to the embodiment shown. Additional, different or fewer components and associated acts may be provided.

Referring to FIGS. 1 and 2, the articles of laundry are placed in separate paths. In the embodiment shown, each separate path includes troughs 12*a,b*, clamps 14*a,b*, plates 16*a,b*, drives 18*a,b*, clamps 20*a,b*, clutch rolls 22*a,b*, and plates 24*a,b*. Additional, different or fewer components may be provided in the separate paths. The articles of laundry are positioned in two different loads into the troughs 12*a,b*, such as by hand or from a machine. The clamps 14*a,b* place the articles into the separate paths from the loads free of user separation. Alternatively, only one path or three or more separate paths are provided.

Both paths operate the same or similar. The "a" and "b" paths are described below together, but are separate paths. The "b" path is configured and operates the same, but deposits the articles of laundry on a different side of a beginning of a common path than the "a" path. The paths may be different in other embodiments.

The troughs 12*a,b* each hold different portions of a load, such as having separate loads. Each load includes a plurality of articles of laundry in an organized or disorganized arrangement. The troughs 12*a,b* are of a same or different sizes, shapes and/or materials, such as metal channels of a same size. In one embodiment, each trough 12*a,b* tapers towards a center in a channel. As the towels are removed from the troughs 12*a,b*, the remaining towels migrate toward the center. At one end, such as associated with a pick-up location for the clamps 14*a,b*, a well or lower region may be provided for holding the load at the pick-up location. Alternatively, the troughs 12*a,b*, do not have a well region.

Gravity may be used to position the loads adjacent to or at a pick-up location. Alternatively, pushers 26*a,b* move in the troughs 12*a,b*. The pushers 26*a,b* are flat plates near or on a bottom of the troughs 12*a,b*, but may be raised plates, fins, a conveyor or other structure. Associated drives, such as belts, air cylinders or other devices, move the pushers 26*a,b*. The pushers 26*a,b* move back and forth in the troughs. As the pushers 26*a,b* move towards a pick-up location, the articles or laundry are pressed towards the pick-up location. The pushers 26*a,b* extend adjacent to the pick-up locations, but avoid contact with the clamps 14*a,b* by limiting the range of movement or timing relative to movement of the clamps 14*a,b*. The pushers 26*a,b* have a flat surface extending to a back of each trough 12*a,b* or have a tapered edge at the back. As the pushers 26*a,b* move back, the pushers 26*a,b* more likely move under articles of laundry. The pushers 26*a,b* dispose at least a portion of the load at pick-up locations. In alternative embodiments, conveyors, vibration mechanisms, tilting mechanisms, or other devices are provided for continually positioning towels near the pick-up locations.

The clamps 14*a,b* are operable to clamp the articles of laundry from the pick-up locations, respectively, of each separate path. The clamps 14*a,b* are each a chuck, scissor clamp, two opposing plates, jaws, pinching roller, pinching conveyors, vacuum device or other structures operable to hold a towel. In one embodiment, the clamps 14*a,b* are scissor clamps with serrated edges for better clamping articles of laundry. Plastic, metal, wood or other materials may be used. The clamps 14*a,b* are actuated by pneumatic cylinders, so one or both jaws of the clamps 14*a,b* connect with the pneumatic cylinder. In alternative embodiments, an electric servo, an air driven cylinder, a hydraulic cylinder, a motor, a valve or other mechanisms are provided for actuating the clamps 14*a,b*.

The clamps 14*a,b* and associated actuators are connected to a drive. In one embodiment, the drive is a pulley and motor with an endless belt or chain. For example, a timing belt with an inverter is used. Other structures may be used, such as pneumatic or hydraulic rodless cylinders. The clamps 14*a,b* and actuators connect with the endless chain, such as using bolts and plates. Using an electrical control and sensors, the drive structure positions the clamps 14*a,b* adjacent to or in the loads of laundry at the pick-up locations.

The articles of laundry for each path are selected by the clamps 14*a,b*. Each clamp 14*a,b* clamps one or more towels in the respective path. The clamps 14*a,b* are sized to most likely select a single towel, such as having jaws that extend only about an inch to two inches.

The clamped towels and the clamps 14*a,b* are moved away from the loads, such as upwards, in each of the separate paths. Timing on the timing chain of the drive mechanism 20 and/or electric light sensors are used to detect that the article of laundry is positioned at a location for further processing. For example, a light sensor detects the presence of the article of laundry at an upper position or other position ready for clamping by a horizontally movable clamp 20.

In the embodiment shown in FIGS. 1 and 2, the clamps 14*a,b* release the articles of laundry before additional clamping. A box or other barrier prevents the released article from moving out of a desired transfer location. The plates 16*a,b* and associated actuators 18*a,b* provide a surface for holding the released articles of laundry. The plates 16*a,b* are metallic, wood, plastic or other material. In one embodiment, a surface, such as a grit surface, is provided to help maintain the articles of laundry on the plates 16*a,b*. In one embodiment, the plates 16*a,b* are flat, but curved or other surfaces may be used. After the clamps 14*a,b* with the articles of laundry move upward past the plates 16*a,b*, the actuators 18*a,b* move the plates to a horizontal or closed position. The clamps 14*a,b* release the articles of laundry onto the plates 16*a,b*. Alternatively, at an upward location of the clamps 14*a,b* while still holding the articles, the clamps 20*a,b* may clamp the laundry, such as clamping a lowest portion or corner of the articles of laundry.

The horizontally movable clamps 20*a,b* and an associated actuator have the same or different structures as described above for the clamp 14*a,b* and the associated actuator. The clamps 20*a,b* include drives 28*a,b* of the same or different structure as the drives discussed above for clamps 14*a,b*, such as a rodless air cylinder, or as an pneumatic motor connected with an endless belt or timing chain to move the clamps 20*a,b* back and forth along a rail.

Through a gap between the surrounding box and the plates 16*a,b* or other exposure of the articles on the plates 16*a,b*, the clamps 20*a,b* clamp the articles of laundry at the transfer locations on the plates 16*a,b*. In response to sensing the article of laundry at the transfer location or in response to opening of the clamps 14*a,b*, the drives 28*a,b* position the clamps 20*a,b* against the articles of laundry or at a set location. Once positioned against the articles or at the location, the clamps 20*a,b* close to grab the articles. The clamps 20*a,b* clamp each article at a random location. In one embodiment, a sensor is provided to detect that the clamp 20*a,b* is in a correct position relative to the article. In other embodiments, the clamp 20*a,b* is positioned at a location where an article should be located.

In response to the closing of the clamps 20*a,b*, the drives 28*a,b* move the clamps 20*a,b* and the article horizontally away from the transfer location. Movement up, down, or in any other direction may be provided. The movement drags the articles to positions on different sides of a surface 30. At least portions of the separate paths are on different sides of the surface 30. The articles of laundry are disposed on opposite sides of the surface 30 in one example.

The clamps 20*a,b* pass over or between clutch rolls 22*a,b* and plates 24*a,b*. The clutch rolls 22*a,b* each include at least one endless belt positioned either in contact or with sufficiently narrow spacing with the respective plate 24*a,b* to grip the articles. The clutch rolls 22*a,b* include two or more rollers stretching the belt tight. The rollers are of metallic, plastic or rubber material, and the belt is fabric, rubber, plastic or other material. In alternative embodiments, the plates 24*a,b* are also clutch rolls, or the clutch rolls 22*a,b* and plate 24*a,b* combinations are clamps. Clutch rolls 22*a,b* without belts may be used. The clutch rolls 22*a,b* are positioned in a horizontal orientation on a plate. The clutch rolls 22*a,b* are driven at about a same speed and direction as the movement of the clamps 20*a,b* and article. The plates 24*a,b* are biased against the clutch rolls 22*a,b* by springs or gas pressure to form a nip.

The articles of laundry are positioned in the nip by gravity, air, rolling of the clutch rolls 22*a,b*, and/or movement of the clamps 20*a,b*. In response to sensing a trailing portion, such as a corner portion of the article, the clutch rolls 22*a,b* are braked to clamp the towel or prevent movement of the towel. For example, a brake clutch is activated. The drives 28*a,b* also stop moving the clamps 20*a,b*. The clutch rolls 22*a,b* and plates 24*a,b* hold the articles of laundry at a time when the articles of laundry are also held by the clamps 20*a,b*. The release of the article is sequential in coordination with the operation of the clamp 32. After the clamp 32 clamps adjacent or at the corner of one of the articles near the nip, the clutch roll 22*a,b* or nip is released. Alternatively, the article is pulled from the nip by the clamp 32. In another alternative, the clutch rolls 22*a,b* and/or plates 24*a,b* are moved away or apart. The clamp 32 holds the article near or at a corner. The clamp 20*a* or *b* still holds the article. During this initial movement of the clamp 32, an edge of the article likely hangs from the clamp 32. The clamps 20*a,b* release the article after the clamp 32 reaches a particular point, the article is sensed in a particular position, or clamp 32 applies sufficient force to pull the article from the clamp 20*a,b*.

The clamp 32 deposits the articles from the different paths onto the surface 30. The surface 30 may be flat or uneven. In one embodiment, the surface is a conveyor with a top portion operable to convey from one side (e.g., side A) towards another side (e.g., side C). The clutch rolls 22*a,b* and clamps 20*a,b* are on other sides (e.g., the separate paths being on opposite sides B and D). The conveyor includes at least two rollers with one or more belts extending between each roller, such as a plurality of straps of fabric, rubber, or other material. The conveyor is wide enough to hold a majority of or the entire article along a longest and/or shortest dimension. The length of the conveyor along with direction of travel is from about 2 to 5 feet, but shorter or longer lengths may be provided. The conveyor is operable to convey articles along the top surface and off an end.

The conveyor includes a platform beneath the straps in between the rollers in one embodiment, but embodiments may be provided without a platform. One or more grooves or slots 34, such as two, are provided in the surface 30. For example, slots 34 are provided through the conveyor and between straps. The platform holds the rollers on each side of the slots 34. In alternative embodiments, the grooves 34 extend into but not through the surface 30. The grooves or slots 34 allow a portion of the clamp 36 to move below the article of laundry on the surface 30. The groove or slot 34 extends over all, most, or other portion of the surface 30 in a direction of conveyance.

The clamp 32, actuator, and/or drive 38,42 (see FIG. 3) are one of the corresponding structures described above for the clamps 14*a,b*, associated actuators and/or drives. In one embodiment, the clamp 32 is a scissor clamp with a corresponding air driven actuator. The clamp 32 connects with two drives 38 and 42. The drives 38,42 are electronic, hydraulic or gas driven motors. For example, the drive 42 is a linear thruster or rodless air cylinder that raises and lowers the clamp 32. The drive 38 is a rodless air cylinder, belt and inverter, or other device. The drive 38 rotates a belt or timing chain along a beam 40 for moving the drive 42 and clamp 32 horizontally. Other arrangements may be used, such as the drive 42 moving the beam and drive 38 up and down.

The clamp 32 is operable to move back and forth between the opposite sides of the surface 30 in order to clamp and move the articles of laundry from the separate paths. The articles from the separate paths are clamped and moved sequentially. The clamp 32 places the articles of laundry from spaced apart locations corresponding to the two separate paths onto a common path (e.g., surface 30) for downstream operation. For each movement between the spaced apart locations, the clamp 32 likely deposits one of the articles of laundry at a deposit location (e.g., on the surface 30) between the spaced apart locations. The back-and-forth operation allows the same clamp 32 to efficiently position articles of laundry from different sides of the surface 30 onto the surface 30.

In one embodiment shown in FIGS. 1-3, the clamp 32 is placed in position 1 over an article of laundry disposed adjacent to the surface 30. The clamp 32 moves downward. In response to pressure, position, or a light sensor, the clamp 32 is actuated to clamp the article of laundry adjacent or at a corner held by the clutch roll 22*a* and plate 24*a*. The article is clamped near the nip of the clutch roll 22*a* and plate 24*a*. The article is clamped below the top of the surface 30, but may be clamped at a higher or same level position. The clamp 32 is driven upwards by the drive 42 while clamping the article of laundry.

Once raised, the clamp 32 is moved by the driver 38. The article of laundry is dragged laterally over the surface 30. The clamp 32 and associated clamped corner of the article move to position 2. A light sensor or position sensor detect the clamp 32 at position 2 or the article of laundry trailing portion. Position 2 is adjacent to the other or opposite side from which the next article of laundry is to be clamped by clamp 32. By dragging the article of laundry across a deposit position, the article is draped across the surface 30. Since the edge may have been isolated by the transfer to the clamp 32, the edge may be exposed and laid on the surface.

The clamp 32 releases the corner of the article of laundry, depositing the article on the surface 30. The release occurs during movement of the clamp 32 from Position 1 to Position 3 (i.e., from one side to the other side of the surface 30). Alternatively, the clamp 32 stops to release the article. The article of laundry is deposited on the surface 30. The edge of the article of laundry may be exposed across the deposit position on the surface 30 or along the deposit location. The edge is preferably exposed on an upstream side relative to the conveyor of the surface 30, but may be exposed on a downstream side or not exposed due to folding of the article.

The clamp 32 continues to Position 3 to clamp another article of laundry at the opposite or other side of the surface 30 or deposit position. The process is repeated for this other article of laundry. In particular, the other article is clamped, moved upward, moved laterally to Position 4 and released. Since articles are clamped adjacent to the corners, the release at Positions 2 and 4 of articles dragged from different directions provides the articles in a same or similar location on the surface 30 despite being from different sides. Different or the same sensors detect the clamp 32 or article at Position 4. The clamp 32 may repeat the process from the original side form Position 4, returning to Position 1.

Once deposited on the surface 30, the conveyor of the surface 30 conveys each article sequentially downstream, but not to an end of the surface 30. The article may be moved to position the article for clamping by the clamp 36. Alternatively, the conveyor moves the article off the end. In another alternative, the article is not conveyed.

The clamp 36 is a single, double or more clamps. In the embodiment shown in FIGS. 1, 2, and 4, the clamp 36 is a double clamp. The clamp 36 and associated actuator is one of the corresponding structures discussed above for the clamps 14*a,b*. The drives 48, 50 connected with the clamp 36 are one of the types of drive structures discussed herein. In one embodiment, the drive 48 is a rodless air cylinder for moving the clamp 36 and drive 50 horizontally or laterally. The drive 50 is a pneumatic rotary motor for rotating the clamp 36 between an extended upward position (shown in solid line in FIG. 4) and a rotated downward position (shown in dashed line in FIG. 4).

In the upward position, the clamp 36 extends into the grooves or slots 34 for clamping and moving the article of laundry. A portion of the clamp 36 is above the article and a portion is below the article. The clamp 36 rotates upwards through the slots 34 after the article is positioned at a desired location on the surface 30 such that any exposed edge may be clamped by the clamp 36. The clamp 36 actuates to clamp the edge of the article, such as trailing edge relative to a direction of conveyance on the surface 30. A light sensor, pressure or location may be used to trigger actuation.

Once clamped, the drive 48 moves the clamp 36 and the article off the surface 30. The clamp 36 moves the article off an end of the surface 30. The clamp 36 is moved linearly through or along the slots or grooves 34. The conveyor of the surface 30 also operates in conjunction with the drive 48 to maintain the article in a substantially or partially laid out arrangement. In one embodiment, the operation of the clamp 36 is timed relative to the operation of the clamp 32. When the conveyor for the surface 30 moves the article deposited by the clamp 32 to a location for clamping by the clamp 36, the conveyor also moves the article currently clamped by the clamp 36 off the surface. The distance between the clamp 32 deposit location and the clamp 36 clamping location is the same or greater than the distance from the clamping location for clamp 36 and an end of the surface 30. Alternatively, the surface 30 is stationary. In other embodiments, the clamp 36 moves the article in a different direction, such as off the surface 30 towards the troughs 12*a,b*.

At the end of the surface 30, the drive 50 rotates the clamp 36 and article of laundry adjacent to another conveyor. The article is rotated away from the surface 30 while clamped. The clamps 36 spread apart to tension the article of laundry. The article is carried to another surface 52, such as a conveyor. The other surface 52 is spaced from the surface 30 at a same or different level. For example, the other surface is at a different level, such as below, above and/or beneath the surface 30. After rotating the clamp 36 downward to a position adjacent and above the other surface 52, the drive 48 moves the clamp 36 and article in an opposite direction than for removing the article from the surface 30. The movement drags the article over the other surface 52.

A light sensor 54 detects a trailing edge adjacent an edge of the surface 52 and triggers release by the clamp 36. Location or other sensors may be used. The article is released in a laid out position on the surface 52.

Once released, the drives 48, 50 move the clamp 36 back. After another article is positioned on the surface 30, the drives 48 and 50 move the clamp 36 upward to position the clamp 36 through the slots 34 for clamping the next article of laundry. The circular or looped movement pattern allows the clamp 36 to operate efficiently. The clamp 36 repeatedly clamps, moves, releases, and moves along the loop. The articles from the separate paths are moved sequentially along a common path by the clamp 36.

The surface 52 is the same or different type of structure and/or materials as the surface 30. In one embodiment, the surface 52 is a conveyor, such as fabric, rubber or other belts extending around two or more rollers with or without a supporting platform. The belts are arranged to leave some area on a stacking side of the conveyor free of belts, such as an area 2-12 inches wide. In alternative embodiments, the belts are provided adjacent to both edges of the conveyor or in a symmetrical arrangement. The surface 52 is at a different height from the floor than the surface 30, but may be a same height.

The article on the surface 52 is spread. The structure and process may be complete, such as conveying the article from the surface 52 for further processing. Further processing may include stacking, folding, drying or other processes. Any of the previous stages may also act to spread the article of laundry. For example, the release by the clamp 32 on the surface 30 spreads the article, at least in part.

One or more sensors may be used to detect erroneously spread articles, such as articles bunched or folded. For example, one or more light sensors may be used to determine whether an article with the expected dimensions is laid out properly. Rejected articles may be removed, such as conveying the articles off the surface 52. Accepted articles may be moved for further processing. Alternatively, the further processing rejects or accepts articles based on whether they are laid out properly, such as clamping at expected locations. A failure of one or more clamps to clamp the article rejects the article.

In one embodiment, the articles are moved to a location for stacking spread laundry from the load of articles of laundry. An apparatus implements a method for stacking spread laundry. The sensors for accepting or rejecting are at the location.

One embodiment of a stacker is shown in FIGS. 1 and 2. For transfer, the surface 52 includes one or more slots 60, such as two slots. The slots 60 extend short of, up to, or under a closest belt on the conveyor. The slots 60 allow travel of the clamp 62 to contact an edge of the article of laundry. For example, the article of laundry is conveyed to adjacent and partially covering the slots 60. Optical or light sensors verify proper position of the article. If verified, the clamp 62 extends along or into the slots 60 to clamp the article.

The clamp 62, associated actuators and drives are one of the structures described herein, such as for the clamps 14*a,b*. In one embodiment, the clamp 62 is a pair of spaced apart clamps actuated by a same actuator. The clamps 62 are spaced apart to clamp adjacent to corners or different portions of an edge and correspond to the slots 60. The clamp 62 extends down from a drive. The drive is a rodless air cylinder, but may be another structure. The drive moves the clamps laterally or horizontally into the slots and over a stacking surface 64.

The clamp 62 clamps an edge of the article of laundry. The article is clamped at a position spaced from the stacking surface 64. The clamp 62 moves the article of laundry by the edge over the stacking surface 64 and any stack to position the article of laundry on the stack. The clamp 62 releases the article onto the stack. A sensor of the clamp 62 or portion of the article triggers release by the clamp 62. The article is released on top of the stack.

To avoid knocking the stack over, the stacking surface 64 is raised and/or lowered by a drive 68, such as a linear thruster or rodless air cylinder. The optical or infrared sensor 66 detects the stack. The sensor 66 is positioned to sense the top of the stack below the region of travel of the clamps 62. The stack is maintained at a position below the sensor 66, such as lowering the stack whenever the sensor 66 is triggered. In one embodiment, the stack and stacking surface 64 are lowered and raised again to just block the sensor 66 each time an article is deposited. The clamps 62 deposit the article on the stack when raised, but may deposit when the stack is lowered. The drive 68 lowers the stack after deposit. The drive 68 moves the surface up until the sensor 66 senses a top of the stack. The raising is halted in response to sensing the top of the stack. The stacking is repeated sequentially for each subsequent article of laundry.

Once a sufficient number of articles are stacked, the stack is removed. The sensor 66 and position of the stacking surface 64 or a count of operations determines a sufficient number of articles. The stack is removed by hand or conveyed. In one embodiment, the stacking surface 64 includes a conveyor. The stacking surface 64 is positioned at a same or similar level as another conveyor. The other conveyor is at any level, such as a same or similar height as the stacking surface in a substantially completely lowered position. A finished stack is conveyed onto the other conveyor. For example, a drive contacts rollers of the conveyor for the stacking surface and an adjacent conveyor. When the stacking surface is lowered, the roller contacts the drive. The drive operates the conveyor to convey the stack. The stack is then bound or wrapped for subsequent use.

While the invention has been described above by reference to various embodiments, it should be understood that many changes and modifications can be made without departing from the scope of the invention. For example, any number of additional stages may be provided. Different clamp, conveyor, sensor, actuator or drive structures may be used, including now known or later developed structures. It is therefore intended that the foregoing detailed description be understood as an illustration of the preferred embodiment of the invention and not as a definition of the invention. It is only the following claims, including all equivalents, that are intended to define the scope of the invention.

What is claimed is:

1. An apparatus for spreading laundry from a load of articles of laundry, the apparatus comprising:

a position for depositing articles of laundry, the position having a position width sufficient to have a width of the article of laundry laid flat within the position width; and a clamp operable to clamp a first article of laundry at a first side out of the position width and release the first article of laundry at the position and operable to clamp a second article of laundry at a second side out of the position width and release the second article of laundry at the position, the second side different than the first side.

2. The apparatus of claim 1 wherein the position is a top portion of a conveyor operable to convey from a third side towards a fourth side, the first and second sides being on opposite sides of the conveyor.

3. The apparatus of claim 2 further comprising:

at least an additional clamp operable to extend into or through the conveyor and clamp the first article of laundry while at the position, carry the first article of laundry off the conveyor, and rotate to position the first article of laundry on another conveyor.

4. The apparatus of claim 1 wherein the clamp is operable to move back and forth between the first and second sides, the clamp operable to clamp and move the first and second articles of laundry sequentially.

5. The apparatus of claim 1 wherein the clamp is operable to sequentially clamp the first article of laundry at the first side, move a portion of the first article of laundry adjacent to the second side, release the first article of laundry, clamp the second article of laundry at the second side, move a portion of the second article of laundry adjacent to the first side, and release the second article of laundry for clamping a third article of laundry at the first side.

6. The apparatus of claim 1 wherein the clamp is operable to clamp the first article of laundry below the position, move upwards while clamping the first article of laundry, and then move laterally to the position.

7. The apparatus of claim 1 wherein the clamp is operable to clamp adjacent a corner of the first article of laundry, move the corner to an opposite side of the position, and expose an edge of the first article of laundry across the position.

8. A method for spreading laundry from a load of articles of laundry, the method comprising:

moving articles of laundry in two separate paths away from the load;

placing articles of laundry from spaced apart locations corresponding to the two separate paths onto a common path downstream of the two separate paths, the common path having a width sufficient to have a width of the article of laundry laid flat, the two separate paths spaced apart by the width; and moving the articles of laundry from the two separate paths along the common path.

9. The method of claim 8 wherein moving the articles of laundry in two separate paths comprises disposing first and second articles of laundry at first and second different locations, respectively; and wherein placing comprises:

moving, with a clamp, the first article of laundry from the first location, and depositing, by the clamp, the first article of laundry at a third location; and moving, with the clamp, the second article of laundry from the second location, and depositing, by the clamp, the second article of laundry at the third location.

10. The method of claim 8 further comprising:

placing the articles of laundry in the separate paths from the load free of user separation.

11. The method of claim 8 wherein placing comprises clamping adjacent a corner of each article of laundry, moving the corner across a deposit location, and releasing the corner such that an edge of at least some of the articles of laundry is exposed along the deposit location.

12. The method of claim 8 wherein placing comprises moving a clamp back and forth between the spaced apart locations, and, for each movement between the spaced apart locations, depositing one of the articles of laundry at a deposit location between the spaced apart locations.

13. The method of claim 8 wherein moving the articles of laundry from the two separate paths along the common path comprises clamping the articles of laundry on the common path, carrying the articles of laundry to a different level and releasing the articles of laundry on the different level.

14. An apparatus for spreading laundry from a load of articles of laundry, the apparatus comprising:

a surface having at least one groove;

a clamp operable to clamp an article of laundry on the surface, the clamp being at least in part in the at least one groove; and a drive operable to move the clamp away from the surface;

wherein the clamp is operable to rotate away from the surface while clamping the article of laundry.

15. The apparatus of claim 14 wherein the groove comprises a slot in the surface, wherein the clamp is operable to extend through the surface to clamp the article of laundry, and wherein the drive is operable to move the clamp through the slot off an end of the surface.

16. The apparatus of claim 14 wherein the clamp comprises two clamps operable to extend into two grooves, respectively.

17. The apparatus of claim 14 wherein the clamp is operable to position the article of laundry on a different surface on a different level by rotating.

18. A method for spreading laundry from a load of articles of laundry, the method comprising:

positioning an article of laundry on a first surface;

extending a clamp through a slot in the first surface;

clamping the article of laundry with the clamp; and moving the article of laundry off the first surface with the clamp;

wherein moving comprises linearly moving the article of laundry and clamp off the first surface and rotating the clamp and article of laundry to a second surface.

19. The method of claim 18 wherein moving comprises moving the clamp through the slot off an end of the first surface.

20. The method of claim 18 further comprising extending, clamping and moving with an additional clamp substantially simultaneously with the clamp.

21. The method of claim 18 wherein rotating the article of laundry to the second surface comprises positioning the article of laundry on the second surface, the second surface beneath the first surface;

further comprising:

releasing the article of laundry and rotating the clamp through the slot.

22. An apparatus for stacking spread laundry from a load of articles of laundry, the apparatus comprising:

a surface operable to support a stack of laundry;

a clamp operable to clamp an edge of an article of laundry at a position spaced from the surface and position the article of laundry on the stack;

a drive operable to move the surface up and down;

a sensor operable to sense a top of the stack; and wherein the drive moves the surface up after the clamp positions the article of laundry on the stack and until the sensor senses a top of the stack.

23. A method for stacking spread laundry from a load of articles of laundry, the method comprising:

grabbing an edge of an article of laundry;

dragging the article of laundry by the edge onto a stack of laundry;

lowering the stack of laundry;

releasing the article of laundry on the stack;

raising the stack of laundry after releasing;

sensing a top of the stack; and halting the raising in response to sensing the top of the stack.

24. A method for spreading laundry from a load of articles of laundry, the method comprising:

selecting a first article of laundry for a first path;

selecting a second article of laundry for a second path separate from the first path;

disposing the first and second articles of laundry on first and second opposite sides, respectively, of a first surface;

sequentially clamping the first and second articles of laundry with a same first clamp in a back and forth operation of the clamp between the first and second opposite sides, the clamp positioning the first and second articles of laundry on the first surface during the back and forth operation;

clamping the first and second articles of laundry sequentially with a second clamp extending through a slot in the first surface; and moving the first and second articles of laundry with the second clamp off the first surface and onto a second surface, the second surface spaced from the first surface.

25. The method of claim 24 wherein moving comprises moving from the first surface to the second surface, the second surface being below or above the first surface, the moving being part of a looped travel path of the second clamp.

26. The method of claim 24 wherein disposing comprises clamping first portions of the first and second articles with third and fourth clamps, respectively, and holding second portions of the first and second articles with first and second clutch rolls;

further comprising:

releasing the second portions sequentially with the sequential clamping by the first clamp while maintaining the clamping of the first portions during an initial movement of the first clamp.

27. The method of claim 24 further comprising:

clamping edges of the first and second articles of laundry while on the second surface;

transferring the first and second articles of laundry to a top of a stack of laundry.

28. The method of claim 24 further comprising:

positioning, with a moving device at a bottom of a trough, a portion of the load to a pick-up location;

wherein selecting comprises clamping the first article of laundry from the pick-up location.

29. An apparatus for spreading laundry from a load of articles of laundry, the apparatus comprising:

a first clamp operable to clamp a first article of laundry;

a second clamp operable to clamp a second article of laundry;

a first drive operable to drive the first clamp to adjacent a first side of a first surface;

a second drive operable to drive the second clamp to adjacent a second side, opposite the first side, of the first surface;

a third clamp operable to sequentially clamp the first and second articles of laundry;

a third drive operable to move the third clamp between the first and second sides, the third clamp operable to deposit the first article of laundry on the first surface during movement from the first side to the second side and operable to deposit the second article of laundry on the first surface during movement from the second side to the first side;

a fourth clamp operable to clamp the first and second articles of laundry sequentially through a slot in the first surface; and a fourth drive operable to move the fourth clamp through the slot and above a second surface, the fourth clamp operable to deposit the first and second articles of laundry sequentially on the second surface.

30. The apparatus of claim 29 wherein the first surface is a first conveyor and the second surface is a second conveyor at a different height than the first conveyor.

31. The apparatus of claim 29 further comprising:

first and second troughs operable to hold first and second portions of the load;

first and second pushers operable to move in the first and second troughs such that the first and second portions are disposed at first and second pick-up locations;

fifth and sixth clamps operable to clamp the first and second articles of laundry from the first and second pick-up locations, respectively, and operable to release the first and second articles of laundry at first and second transfer locations, the first and second clamps operable to clamp the first and second articles of laundry at the first and second transfer locations; and first and second clutch rolls operable to hold the first and second articles of laundry at a time when the first and second articles of laundry are also held by the first and second clamps;

wherein the third clamp is operable to clamp the first and second articles of laundry adjacent to the clutch rolls.

32. The apparatus of claim 29 further comprising:

a fifth clamp operable to clamp sequentially edges of the first and second articles of laundry while on the second surface and transfer the first and second articles of laundry to a top of a stack of laundry.

* * * * *